US011827035B2

(12) United States Patent
Condello et al.

(10) Patent No.: US 11,827,035 B2
(45) Date of Patent: Nov. 28, 2023

(54) SYSTEM AND METHOD FOR PRINTING COLOR IMAGES ON SUBSTRATES IN AN INKJET PRINTER

(71) Applicant: Xerox Corporation, Norwalk, CT (US)

(72) Inventors: Anthony S. Condello, Webster, NY (US); Jack T. LeStrange, Macedon, NY (US); Palghat S Ramesh, Pittsford, NY (US); Joseph C. Sheflin, Macedon, NY (US); Peter Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 175 days.

(21) Appl. No.: 17/491,759

(22) Filed: Oct. 1, 2021

(65) Prior Publication Data

US 2023/0108246 A1 Apr. 6, 2023

(51) Int. Cl.
*B41J 2/21* (2006.01)
*B41J 25/00* (2006.01)

(52) U.S. Cl.
CPC ..... *B41J 2/2121* (2013.01); *B41J 25/001* (2013.01)

(58) Field of Classification Search
CPC . B41J 2/2121; B41J 25/001; B41J 2/21; B41J 2/2103; B41J 2/525
See application file for complete search history.

(56) References Cited

U.S. PATENT DOCUMENTS

| | | | | |
|---|---|---|---|---|
| 9,465,563 | B2 * | 10/2016 | Kawaguchi | B41J 11/0095 |
| 2003/0184640 | A1 * | 10/2003 | Sasaki | B41J 11/0025 347/197 |
| 2019/0255867 | A1 | 8/2019 | Mueller | |
| 2020/0180302 | A1 | 6/2020 | Yraceburu et al. | |
| 2020/0198364 | A1 | 6/2020 | Schneider et al. | |

* cited by examiner

*Primary Examiner* — Kristal Feggins
(74) *Attorney, Agent, or Firm* — Maginot Moore & Beck LLP

(57) ABSTRACT

A method of operating a printer extends the print zone of the printer by separating at least two printhead modules in the print zone by a distance that is greater than a width of a printhead module. The printhead modules are operated to print multiple color separations of an ink image and operates an optical sensors generates image data of the printed multiple color separations. The image data of the printed color separations are used to adjust distances between printhead modules in the print zone.

20 Claims, 5 Drawing Sheets

SYSTEM AND METHOD FOR PRINTING COLOR IMAGES ON SUBSTRATES IN AN INKJET PRINTER

TECHNICAL FIELD

This disclosure relates generally to devices that produce ink images on media, and more particularly, to the image quality of the images produced by such devices.

BACKGROUND

Inkjet imaging devices, also known as inkjet printers, eject liquid ink from printheads to form images on an image receiving surface. The printheads include a plurality of inkjets that are arranged in an array. Each inkjet has a thermal or piezoelectric actuator that is coupled to a printhead controller. The printhead controller generates firing signals that correspond to digital data content corresponding to images. The actuators in the printheads respond to the firing signals by expanding into an ink chamber to eject ink drops onto an image receiving member and form an ink image that corresponds to the digital image content used to generate the firing signals. The image receiving member can be a continuous web of media material or a series of media sheets.

Inkjet printers used for producing color images typically include multiple printhead assemblies. Each printhead assembly includes one or more printheads that typically eject a single color of ink. In a typical inkjet color printer, four printhead assemblies are positioned in a process direction with each printhead assembly ejecting a different color of ink. The four ink colors most frequently used are cyan, magenta, yellow, and black. The common nomenclature for such printers is CMYK color printers. Some CMYK printers have two printhead assemblies that print each color of ink. The printhead assemblies that print the same color of ink are offset from each other by one-half of the distance between adjacent printheads in the cross-process direction to double the pixels per inch density of a line of the color of ink ejected by the printheads in the two assemblies. As used in this document, the term "process direction" means the direction of movement of the image receiving members as they pass the printheads in the printer and the term "cross-process direction" means a direction that is perpendicular to the process direction in the plane of the image receiving members.

High quality prints increasingly use coated substrates for brochures, magazine covers, and the like. These coated substrates, especially when moved at high speeds past the printheads, produce challenges for the quality of color ink images because the different colored inks overlay one another and are not readily absorbed by the coated substrates. Consequently, they spread over the surface of the coated substrates before the substrates enter a dryer that removes water and solvents from the ink to fix the image to the coated substrates. These unabsorbed inks produce an image defect known as overlay graininess. Developing inkjet color printers that enable ink images on coated substrates to be produced with little or no overlay graininess would be beneficial.

SUMMARY

A color inkjet printer is configured to produce color images on coated substrates with little or no overlay graininess. The color inkjet printer includes a plurality of printhead modules arranged to form a print zone that is longer in a process direction than a distance from first printhead module in the process direction to a last printhead module in the process direction when the printhead modules are immediately adjacent to one another, and an optical sensor configured to generate image data of substrates printed by the plurality of printhead modules, the optical sensor being positioned after the last printhead module in the process direction.

A method of operating a color inkjet printer produces color images on coated substrates with little or no overlay graininess. The method includes arranging a plurality of printhead modules to form a print zone that is longer in a process direction than a distance from first printhead module in the process direction to a last printhead module in the process direction when the printhead modules are immediately adjacent to one another, and generating with an optical sensor image data of substrates printed by the plurality of printhead modules, the optical sensor being positioned after the last printhead module in the process direction and the image data of the substrates being used to adjust positions of the printhead modules in the print zone.

BRIEF DESCRIPTION OF THE DRAWINGS

The foregoing aspects and other features of a color inkjet printer and color inkjet printer operational method that produces color images on coated substrates with little or no overlay graininess are explained in the following description, taken in connection with the accompanying drawings.

DETAILED DESCRIPTION

Figure 1:
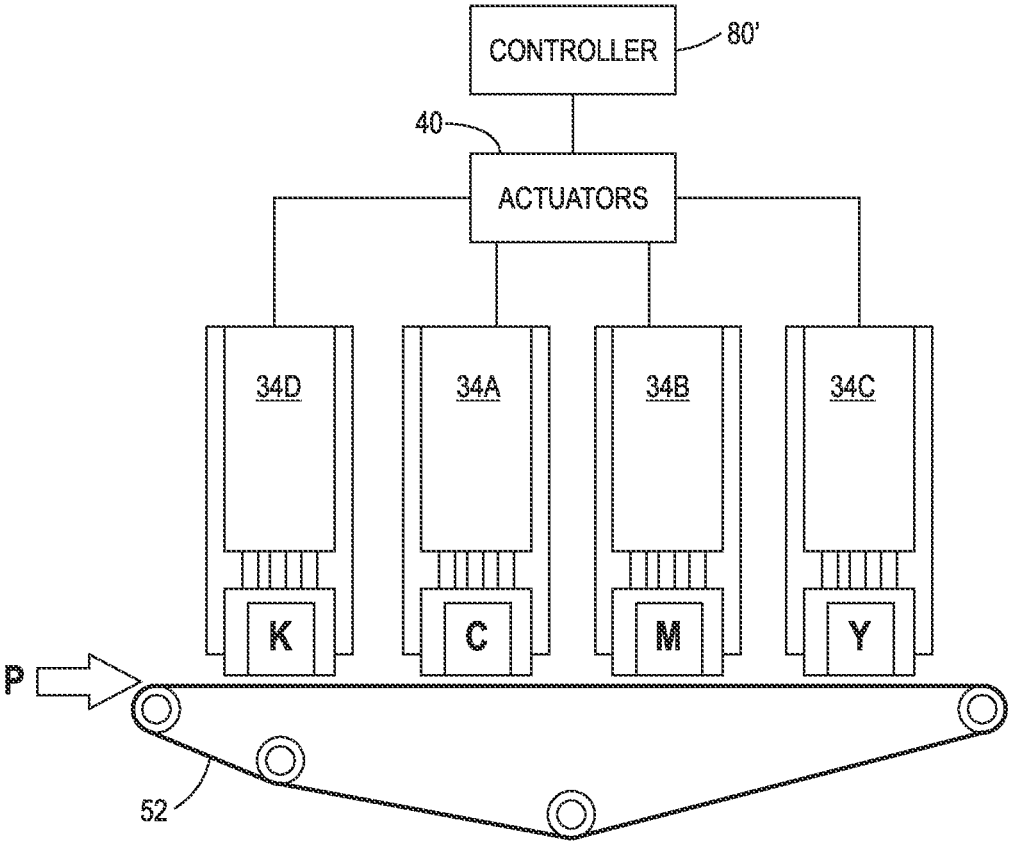
FIG. 1 is a schematic drawing of a print zone configuration that produces color images on coated substrates with little or no overlay graininess.

For a general understanding of the environment for the printer, the printer operational method, and printer configuration method disclosed herein as well as the details for the printer, the printer operational method, and printer configuration method, reference is made to the drawings. In the drawings, like reference numerals have been used throughout to designate like elements. As used herein, the word "printer" encompasses any apparatus that ejects ink drops onto different types of media to form ink images.

Figure 4:
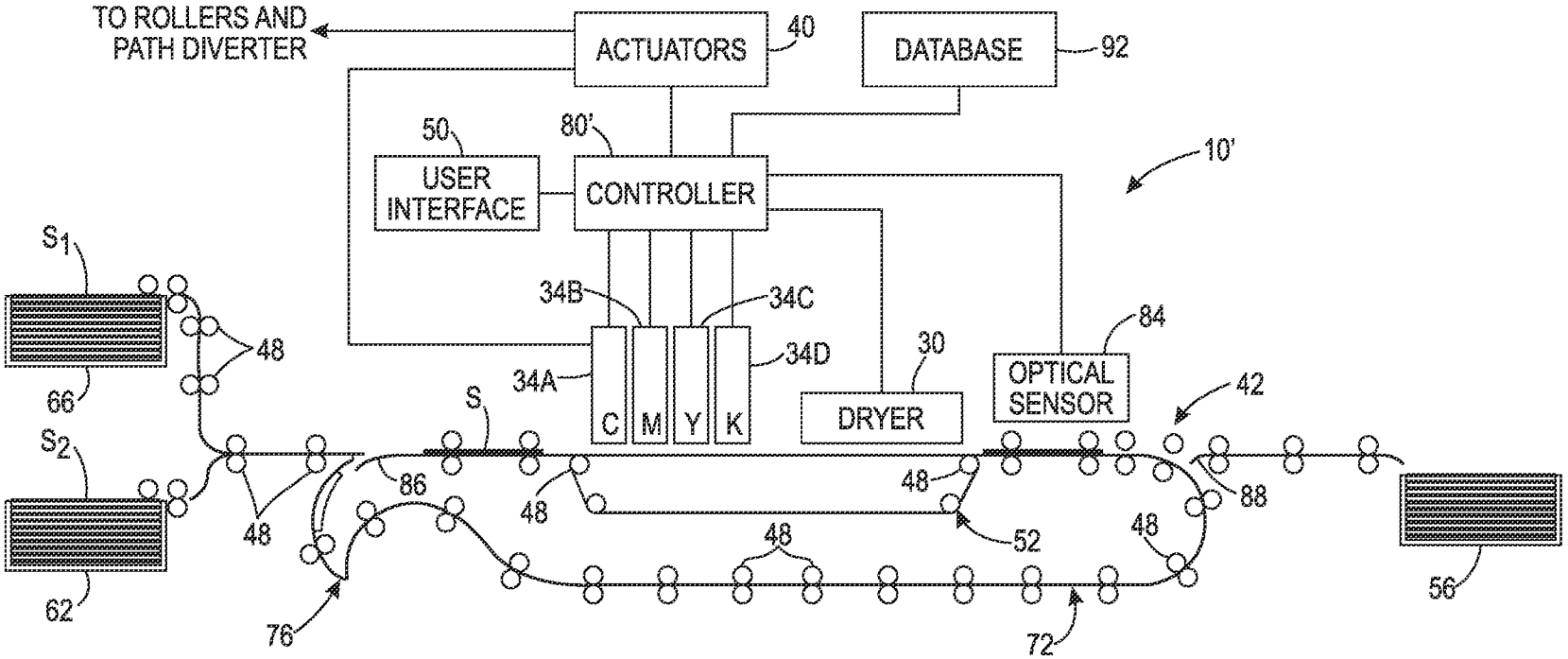
FIG. 4 PRIOR ART
FIG. 4 is a schematic drawing of a prior art color inkjet printer that cannot produce color images on coated substrates with little or no overlay graininess.

FIG. 4 depicts a prior art high-speed color inkjet printer 10 that cannot produce color images on coated substrates with little or no overlay graininess. As illustrated, the printer 10 is a printer that directly forms an ink image on a surface of a media sheet stripped from one of the supplies of media sheets $S_1$ or $S_2$ and the sheets S are moved through the printer 10 by the controller 80 operating one or more of the actuators 40 that are operatively connected to rollers or to at least one driving roller of conveyor 52 that comprise the media transport 42. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction. Although printer 10 is depicted with only two supplies of media sheets, the printer can be configured with three or more sheet supplies, each containing a different type or size of media.

Figure 5:
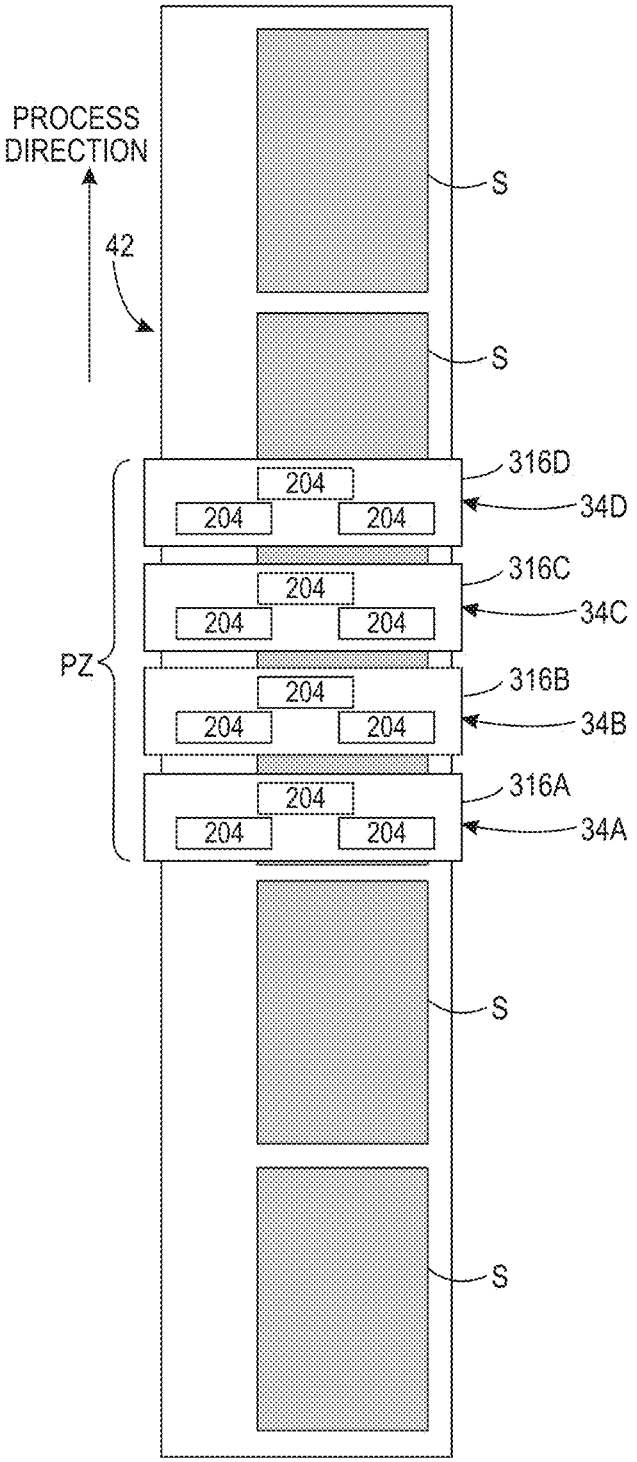
FIG. 5 PRIOR ART
FIG. 5 depicts the print zone in the printer of FIG. 7.

The print zone PZ in the prior art printer of FIG. 4 is shown in FIG. 5. As used in this document, the term print zone means an area having a length in the process direction commensurate with the distance from the first inkjets that a sheet passes in the process direction to the last inkjets that a sheet passes in the process direction and a width that is the maximum distance between the most outboard inkjet and the most inboard inkjet on opposite sides of the print zone that are directly across from one another in the cross-process direction. Each printhead module 34A, 34B, 34C, and 34D shown in FIG. 5 has three printheads 204 mounted to a printhead carrier plate 316A, 316B, 316C, and 316D, respectively.

As shown in FIG. 4, the printed image passes under an image dryer 30 after the ink image is printed on a sheet S. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air using a fan or other pressurized source of air over the ink to supplement the evaporation of the water or solvent from the ink. The air is then collected and evacuated by air returns to reduce the interference of the dryer air flow with other components in the printer.

A duplex path 72 is provided to receive a sheet from the transport system 42 after a substrate has been printed and move it by the rotation of rollers in an opposite direction to the direction of movement past the printheads. At position 76 in the duplex path 72, the substrate can be turned over so it can merge into the job stream being carried by the media transport system 42. The controller 80 is configured to flip the sheet selectively. That is, the controller 80 can operate actuators to turn the sheet over so the reverse side of the sheet can be printed or it can operate actuators so the sheet is returned to the transport path without turning over the sheet so the printed side of the sheet can be printed again. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 4, a substrate from media transport 42 is diverted to the duplex path 72. Rotating the pivoting member 88 in the clockwise direction from the diverting position closes access to the duplex path 72 so substrates on the media transport continue moving to the receptacle 56. Another pivoting member 86 is positioned between position 76 in the duplex path 72 and the media transport 42. When controller 80 operates an actuator to rotate pivoting member 86 in the counterclockwise direction, a substrate from the duplex path 72 merges into the job stream on media transport 42. Rotating the pivoting member 86 in the clockwise direction closes the duplex path access to the media transport 42.

As further shown in FIG. 4, the printed media sheets S not diverted to the duplex path 72 are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80, which is configured to determine which inkjets, if any, that were operated to eject ink did in fact do so or if they did not eject an ink drop having an appropriate mass or that landed errantly on the sheet. Any inkjet operating in this manner is called an inoperative inkjet in this document. The controller can store data identifying the inoperative inkjets in a memory operatively connected to the controller. A user can operate the user interface 50 to obtain reports displayed on the interface that identify the number of inoperative inkjets and the printheads in which the inoperative inkjets are located. The optical sensor can be a digital camera, an array of LEDs and photodetectors, or other devices configured to generate image data of a passing surface. As already noted, the media transport also includes a duplex path that can turn a sheet over and return it to the transport prior to the printhead modules so the opposite side of the sheet can be printed. While FIG. 4 shows the printed sheets as being collected in the sheet receptacle, they can be directed to other processing stations (not shown) that perform tasks such as folding, collating, binding, and stapling of the media sheets.

Operation and control of the various subsystems, components and functions of the machine or printer 10 are performed with the aid of a controller or electronic subsystem (ESS) 80. The ESS or controller 80 is operably connected to the components of the printhead modules 34A-34D (and thus the printheads), the actuators 40, and the dryer 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image content data for an image to be produced are sent to the controller 80 from either a scanning system or an online or work station connection for processing and generation of the printhead control signals output to the printhead modules 34A-34D. Along with the image content data, the controller receives print job parameters that identify the media weight, media dimensions, print speed, media type, ink area coverage to be produced on each side of each sheet, location of the image to be produced on each side of each sheet, media color, media fiber orientation for fibrous media, print zone temperature and humidity, media moisture content, and media manufacturer. As used in this document, the term "print job parameters" means non-image content data for a print job and the term "image content data" means digital data that identifies an ink image to be printed on a media sheet.

Using like reference numbers to identify like components, FIG. 1 depicts a print zone configuration that extends the print zone for a printer and a controller 80' that has been configured to perform the process 300 described below to produce color images on coated substrates with little or no overlay graininess. The printhead modules in FIG. 1 have been rearranged from the printhead modules in FIG. 5. This change is particular to one embodiment of the new printer that produces color images on coated substrates with little or no overlay graininess. Other printhead module arrangements are possible. What is significant is that the print zone in FIG. 1 is longer in the process direction P than the print zone in FIG. 5 because the distance between the first printhead module 34D and the last printhead module 34C in FIG. 1 is longer than the distance between the first printhead module 34A and the last printhead module 34D in the print zone FIG. 5 in which the printhead modules are positioned immediately adjacent to one another. As used in this document, the term "immediately adjacent printhead module" means printhead modules that abut one another. This increased distance enables the color separations printed by each module to be exposed to the thermal environment within the print zone for a longer period of time than the color separations printed by each module in FIG. 5. This increased time of exposure enables the ink drops in the color separations to level somewhat and to evaporate water or other solvents somewhat before additional ink drops are added to the ink image on the substrate in the print zone.

The interaction between the solvents and pigments in different color separations can sometimes cause overlay graininess. To address this issue, the printer of FIG. 1 includes a controller 80' that is operatively connected to actuators 40 that are operatively connected to the printhead modules 34A to 34D. The controller 80' is also configured with programmed instructions stored in a memory operatively connected to the controller 80' that, when executed by the controller, cause the controller to operate some or all of the actuators so connected to alter the distances between the printhead modules in the process direction. Additionally, the controller 80' is configured with programmed instructions stored in the memory that cause the controller to analyze the image data of ink images on the printed substrates generated by the optical sensor 84 to detect the onset of overlay graininess in the ink images.

Specifically, the controller 80' measures the size of the ink drops (dot gain) or lines of ink (line growth) in the various color separations forming the ink images. Both dot gain and line growth indicate the amount of ink drop spreading occurring during the printing of an ink image. If it is too large, overlay graininess occurs. Alternatively or additionally to the use of the ink images of a print job, test patterns of ink drops or ink lines can be printed within the ink image area or margins outside the ink image area for dot gain and line growth measurement purposes. The dot gain and line growth is measured for each color separation as well as the overlays of two or more of the color separations to evaluate the interaction between color separations. If the measured dot gain or line growth exceeds a predetermined threshold, one or more of the actuators are operated to move one or more of the printhead modules to increase the distance between some of the printhead modules. Image data of subsequent ink images are analyzed to determine whether the distance changes were adequate to address the measured dot gain or line growth. If the change or changes did not result in dot gain or line growth being less than the predetermined threshold, further printhead module movements are made in an effort to attenuate the conditions leading to overlay graininess. The actuators 40 operatively connected to the printhead modules are independently controlled because the inks ejected by the various printhead modules are different in color (pigments) and viscosity. Thus, some interactions between color separations may lead to errant dot gain and line growth while may not.

Figure 2:
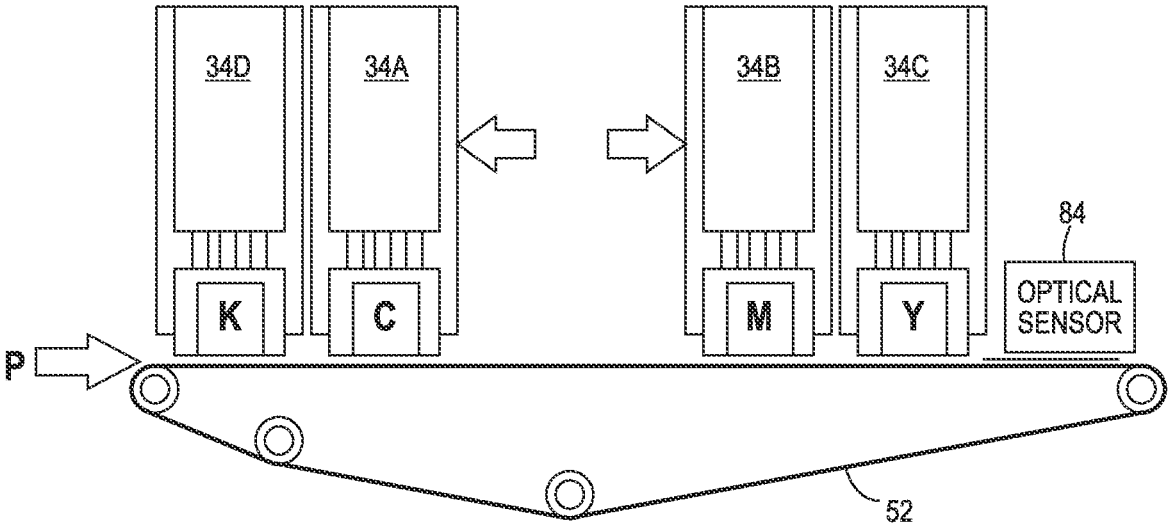
FIG. 2 depicts the positions to which the printhead modules have been moved to address overlay graininess occurring from the interaction of the KC color separation with the magenta ink ejected by the magenta printhead module of FIG. 1.

For example, in the scenario depicted in FIG. 2, the controller 80' has identified from the drops and lines of cyan and magenta ink the onset of the drops bleeding together and spreading out further than required for acceptable image quality. To address this issue, the controller 80' operates the actuators 40 operatively connected to the printhead modules 34A and 34B to move them away from each other and closer to printhead modules 34D and 34C, respectively. This movement enables the cyan ink drops and lines to be at least partially fixed before the magenta ink drops are ejected onto the substrate. Subsequent ink images on the substrates are analyzed to determine whether this movement has attenuated the interaction between the cyan and magenta inks sufficiently to bring the dot gain and line growth measurements for these inks within the predetermined threshold. Additionally, the image data of the ink images are analyzed to determine whether the shorter distance between printhead module 34D and printhead module 34A and the shorter distance between printhead module 34B and printhead module 34C has resulted in interactions between the black and cyan inks or interactions between the magenta and yellow inks that tend toward overlay graininess. If such interactions are detected, then the controller 80' further adjusts the process direction P distances between the printhead modules.

Figure 3:
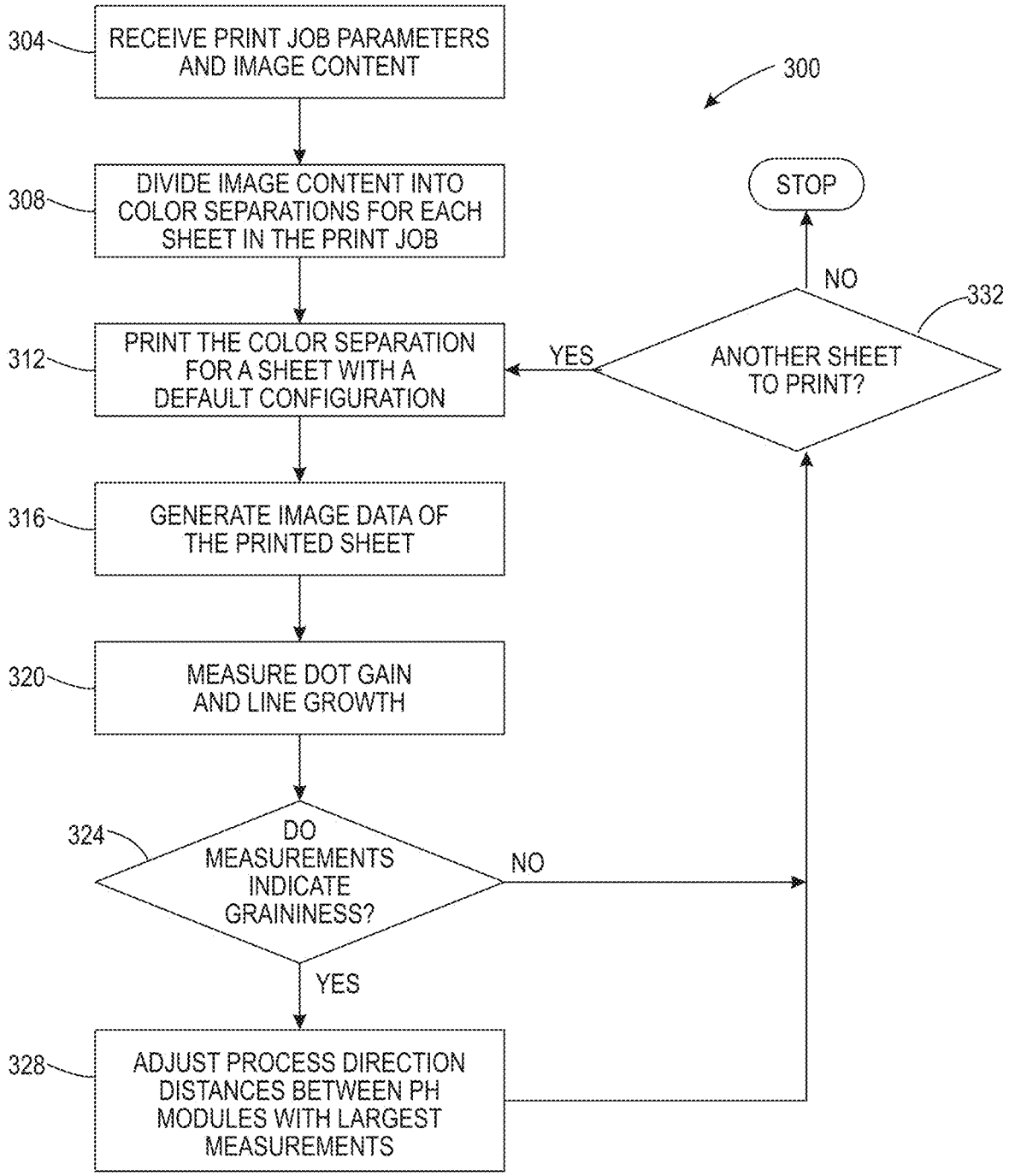
FIG. 3 is a flow diagram of a process for moving the printhead modules of FIG. 1 to produce color images on coated substrates with little or no overlay graininess.

FIG. 3 depicts a flow diagram for a process 300 that operates the actuators 40 to configure the print zone to address overlay graininess. In the discussion below, a reference to the process 300 performing a function or action refers to the operation of a controller, such as controller 80', to execute stored program instructions to perform the function or action in association with other components in the printer. The process 300 is described as being performed for the print zone of FIG. 1 for illustrative purposes.

The process 300 begins with the controller receiving the parameters and the image content data for a print job (block 304). The image content data for each sheet is divided into a color separation for each printhead module (block 308). The process prints each color separation using a default configuration of the printhead modules, such as the one shown in FIG. 1 (block 312). The optical sensor generates image data of the ink images formed with the printed color separations (block 316) and the dot gain and line growth of ink drops and lines in the image data of the ink image are measured (block 320). If the measured dot gain or line growth for a color separation exceeds a predetermined threshold corresponding to the onset of overlay graininess (block 324), then the process increases the distances between the printhead modules that are most contributing to the overlay graininess (block 328). The process continues until all of the ink images have been printed (block 332).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A color inkjet printer comprising:

a plurality of printhead modules arranged to form a print zone that is longer in a process direction than a distance from a first printhead module in the plurality of printhead modules in the process direction to a last printhead module in the plurality of printhead modules in the process direction when the printhead modules in the plurality of printhead modules are immediately adjacent to one another; and an optical sensor configured to generate image data of substrates printed by the plurality of printhead modules, the optical sensor being positioned after the last printhead module in the plurality of printhead modules in the process direction.

2. The color inkjet printer of claim 1 wherein a first pair of adjacent printhead modules in the plurality of printhead modules are separated by a first distance and a second pair of adjacent printhead modules in the plurality of printhead modules are separated by a second distance that is different than the first distance, all of the printhead modules in the first pair of adjacent printhead modules in the plurality of printhead modules and all of the printhead modules in the second pair of adjacent printhead modules in the plurality of printhead modules being different from one another.

3. The color inkjet printer of claim 1 wherein adjacent printhead modules in the plurality of printhead modules are separated by a same distance.

4. The color inkjet printer of claim 3 further comprising:

a controller operatively connected to the printhead modules in the plurality of printhead modules and the optical sensor, the controller being configured to:

receive image content data for a substrate in a print job;

generate a color separation for each printhead module in the plurality of printhead modules using the image content data for the substrate;

operate each printhead module in the plurality of printhead modules to print the color separations for each printhead module in the plurality of printhead modules onto the substrate; and use image data of the printed color separations generated by the optical sensor to adjust a distance between at least two of the printhead modules in the plurality of printhead modules.

5. The color inkjet printer of claim 4 further comprising:

the controller is further configured to:

adjust the distance between the at least two of the printhead modules in the plurality of printhead modules.

6. The color inkjet printer of claim 5, the controller being further configured to:

identify a measured size of ink drops in the printed color separations; and adjust the distance between the at least two of the printhead modules when the measured size of at least some of the ink drops in the printed color separations exceed a predetermined threshold.

7. The color inkjet printer of claim 6, the controller being further configured to:

move the printhead modules in the plurality of printhead modules independently from one another.

8. The color inkjet printer of claim 7, the controller being further configured to:

move a first printhead module in the plurality of printhead modules to be immediately adjacent a second printhead module in the plurality of printhead modules to increase a distance between the first printhead module in the plurality of printhead modules and a third printhead module in the plurality of printhead modules.

9. The color inkjet printer of claim 8, the controller being further configured to:

move a third printhead module in the plurality of printhead modules to be immediately adjacent a fourth printhead module in the plurality of printhead modules to increase further the distance between the first printhead module in the plurality of printhead modules and the third printhead module in the plurality of printhead modules.

10. The color inkjet printer of claim 9 wherein each printhead module in the plurality of printhead modules is configured to eject a color of ink different than a color of ink ejected by each of the other printhead modules in the plurality of printhead modules.

11. A method for operating a printer comprising:

arranging a plurality of printhead modules to form a print zone that is longer in a process direction than a distance from a first printhead module in the process direction in the plurality of printhead modules to a last printhead module in the process direction in the plurality of printhead modules when the printhead modules in the plurality of printhead modules are immediately adjacent to one another; and generating with an optical sensor image data of substrates printed by the plurality of printhead modules, the optical sensor being positioned after the last printhead module in the process direction in the plurality of printhead modules and the image data of the substrates being used to adjust positions of the printhead modules in the plurality of printhead modules in the print zone.

12. The method of claim 11, the arranging of the plurality of printhead modules further comprising:

arranging the plurality of printhead modules so adjacent printhead modules in the plurality of printhead modules are separated by different distances.

13. The method of claim 11, the arranging of the plurality of printhead modules further comprising:

arranging the plurality of printhead modules so adjacent printhead modules in the plurality of printhead modules are separated by a same distance.

14. The method of claim 13 further comprising:

receiving with a controller operatively connected to the printhead modules in the plurality of printhead modules and the optical sensor image content data for a substrate in a print job;

generating with the controller a color separation for each printhead module in the plurality of printhead modules using the image content data for the substrate;

operating with the controller each printhead module in the plurality of printhead modules to print the color separations for each printhead module in the plurality of printhead modules onto the substrate; and using image data of the printed color separations generated by the optical sensor to adjust a distance between at least two printhead modules in the plurality of printhead modules.

15. The method of claim 14 further comprising:

adjusting a distance between the at least two printhead modules in the plurality of printhead modules.

16. The method of claim 15 further comprising:

identifying with the controller a measured size of ink drops in the image data of the printed color separations; and adjusting the distance between the at least two printhead modules in the plurality of printhead modules when the measured size of at least some of the ink drops in the printed color separations exceed a predetermined threshold.

17. The method of claim 16 further comprising:

moving the printhead modules in the plurality of printhead modules independently from one another.

18. The method of claim 17 further comprising:

moving a first printhead module in the plurality of printhead modules to be immediately adjacent a second printhead module in the plurality of printhead modules to increase a distance between the first printhead module in the plurality of printhead modules and a third printhead module in the plurality of printhead modules.

19. The method of claim 18 further comprising:

moving a third printhead module in the plurality of printhead modules to be immediately adjacent a fourth printhead module in the plurality of printhead modules to increase further the distance between the first printhead module in the plurality of printhead modules and the third printhead module in the plurality of printhead modules.

20. The method of claim 19 further comprising:

configuring each printhead module in the plurality of printhead modules to eject a color of ink different than a color of ink ejected by each of the other printhead modules in the plurality of printhead modules.

* * * * *